United States Patent [19]

Steinemann

[11] 4,010,876

[45] Mar. 8, 1977

[54] ARRANGEMENT FOR THE DELIVERY OF MEASURED QUANTITIES OF THE MOLTEN CONTENTS OF A STORAGE VESSEL

[75] Inventor: Robert Steinemann, Schaffhausen, Switzerland

[73] Assignee: Georg Fischer Aktiengesellschaft, Schaffhausen, Germany

[22] Filed: Mar. 25, 1975

[21] Appl. No.: 561,687

[30] Foreign Application Priority Data

Apr. 9, 1974 Switzerland ..... 4982/74

[52] U.S. Cl. ..... 222/595; 164/55; 164/337

[51] Int. Cl.[2] ..... B22D 39/00

[58] Field of Search .... 222/394, 399, 603, 146 HE, 222/595; 164/55–60, 155, 251, 337; 73/290 R, 304 C

[56] References Cited

UNITED STATES PATENTS

| | | | |
|---|---|---|---|
| 2,660,769 | 12/1953 | Bennett | 222/146 HE |
| 2,936,326 | 5/1960 | Tawa | 164/251 X |
| 3,384,150 | 5/1968 | Newsome | 164/155 |
| 3,467,167 | 7/1969 | Mahin | 164/56 |
| 3,510,116 | 5/1970 | Harvill et al. | 222/394 UX |
| 3,654,970 | 4/1972 | Teboul | 164/155 X |

FOREIGN PATENTS OR APPLICATIONS

| | | | |
|---|---|---|---|
| 1,947,728 | 4/1971 | Germany | 164/337 |

*Primary Examiner*—Robert B. Reeves
*Assistant Examiner*—David A. Scherbel
*Attorney, Agent, or Firm*—Toren, McGeady and Stanger

[57] ABSTRACT

An arrangement for the delivery of predetermined amounts from a sealed and heated storage vessel. The storage vessel has an overflow pipe and a closeable opening for insertion of a molten charge. An intermediate vessel, which is sealed, communicates with the overflow pipe of the storage vessel. The intermediate vessel has a delivery pipe for delivering measured quantities of the molten metal. The intermediate vessel also includes means for measuring the molten charge within the vessel. The flow of the molten metal is controlled by pressurized gas lines which are selectively turned on and off. The arrangement includes a throttle control and storage element for controlling the quantity of molten charge delivered as a function of time. Means for supplying an inoculant or seeding agent are disclosed.

3 Claims, 2 Drawing Figures

ARRANGEMENT FOR THE DELIVERY OF MEASURED QUANTITIES OF THE MOLTEN CONTENTS OF A STORAGE VESSEL

BACKGROUND OF THE INVENTION

The present invention relates to pressurized gas-operated arrangements for the delivery of predetermined amounts or doses of the molten contents of a sealed and heated storage vessel having an overflow pipe.

Various arrangements are known in which predetermined amounts of liquid metal can be delivered in doses or measured quantities by the use of gas under pressure during the delivery of the metal. Such arrangements preferably use the principle of communicating vessels.

U.S. Pat. No. 3,058,180 discloses an arrangement wherein dosed amounts of a melt can be cast. The delivery in doses is effected by lowering the melt level in a storage vessel by a certain amount per casting cycle. The lowering is effected by means of increasing gas pressure. For controlling the required amounts of gas, pyrometers are lowered as probes into the fill holes, or the weight increase of the mold during the casting is measured. With such an arrangement, the storage vessel can only be kept sealed or closed to a limited extent. This occurs because the arrangement operates on the principle of communicating vessels and therefore it is connected at the bottom to uncloseable inlet and outlet openings. Furthermore, this arrangement has the disadvantage that exact dosing is not possible because of the fluctuating movement of large amounts of metal. These movements occur due to gas pressure fluctuations or during acceleration or deceleration. Another disadvantage exists in relatively large-surfaced vessels, since the delivery of small amounts results in only a minimal lowering of the liquid level in the storage vessel. This minimal lowering can only be inaccurately measured with available measuring instruments.

An arrangement is also known from British Patent No. 1,100,475 where liquid metal is conducted from a sealed and heated storage vessel by means of gas pressure. The liquid metal flows through an overflow pipe into an open vessel from which it is delivered either for continuous feeding of injection molding machines or for the intermittent filling of molds. The controlled delivery is achieved by the opening and closing of an outlet opening in the bottom of the vessel by means of a stopper. In this manner dosed amounts of liquid metal can only be cast with limited accuracy, and further, the melt is exposed to atmospheric influences in the open stopper vessel.

SUMMARY OF THE INVENTION

An object of the present invention, therefore, is directed toward a solution of the problem of delivering the molten content (particularly a molten metal or a liquid slag) from a storage vessel in small measured amounts and in rapid succession.

It is a further object of the present invention to provide an arrangement for the measured delivery of small amounts of molten metal from a storage vessel wherein the vessel is designed as a heat-maintaining vessel.

It is another object of the present invention to provide an arrangement for the delivery of small measured amounts of molten metal wherein the measurement of the delivered quantity of metal is made quite accurately.

It is a still further object of the present invention to provide an arrangement for delivery of predetermined amounts of molten metal in a storage vessel where the delivery is controlled by pressurized gas.

It is still another object of the present invention to provide an arrangement for the delivery of predetermined amounts of molten metal in a heated storage vessel wherein the storage vessel is sealed to prevent deleterious effects by atmospheric conditions.

It is yet another object of the present invention wherein an arrangement for delivering molten metal includes means for controlling the slope of the amount of metal delivered as a function of time.

It is also an object of the present invention to provide an arrangement for the delivery of molten metal in measured quantities wherein means are provided for supplying predetermined amounts of a seeding agent or inoculant to the measured amount of metal for delivery.

In accordance with the present invention, an arrangement is provided for the delivery of predetermined amounts of a sealed and heated storage vessel having an overflow pipe wherein delivery is controlled by pressurized gas. The arrangement comprises a storage vessel having an overflow pipe and a closeable opening to insert a molten charge. An intermediate vessel is included which is sealed and into which the overflow pipe opens. The intermediate vessel is provided with a rising delivery pipe. Means are included in the intermediate vessel for measuring the molten charge contained in the intermediate vessel. First gas pressure lines are also provided which have pressure release means, the lines for providing pressurized gas to the storage vessel, and second gas pressure lines which have pressure release means for providing pressurized gas to the intermediate vessel. The first and second lines are individually controllable.

For a better understanding of the present invention together with other purposes and objects thereof, reference is made to the following detailed description and accompanying drawings while the scope of the invention is pointed out in the appended claims.

DESCRIPTION OF THE PRESENT INVENTION

Figures 1, 2:
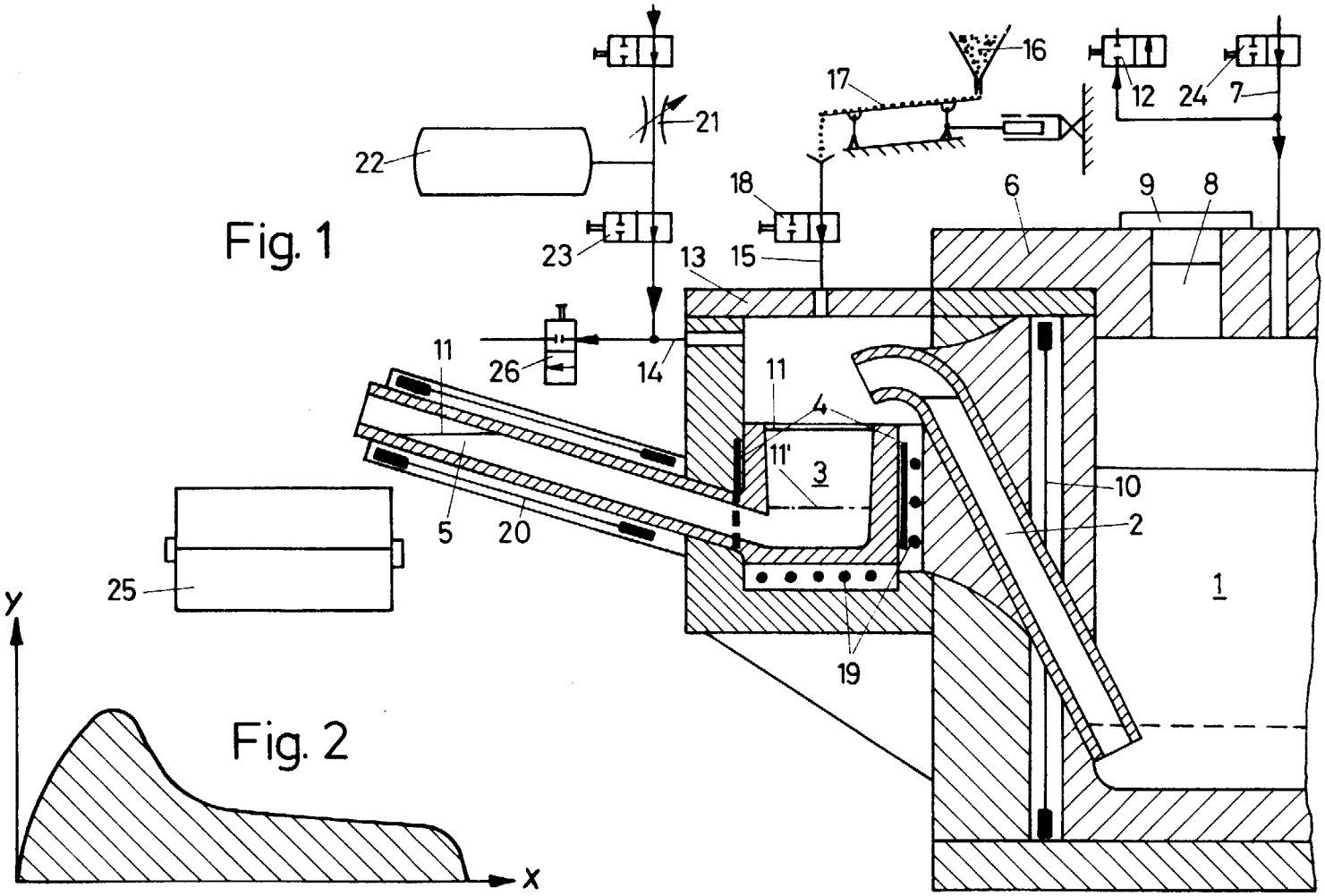
FIG. 1 illustrates a dosing apparatus or arrangement constructed in accordance with the present invention which is shown in longitudinal section and partly in schematic form.
FIG. 2 illustrates a graph of the cast amount of the melt as a function of time in one possible representation of the present invention.

Referring initially to FIG. 1, shown there is a storage vessel 1, for example, as intended for use for a cast iron melt, having an overflow pipe 2 rising from the bottom thereof and opening into an intermediate vessel 3. As a level gauge or flow meter, means for measurement of the molten fluid in the intermediate vessel is arranged on the vessel 3. Preferably a condenser 4 is such a measurement means and is disposed outside of the vessel in vertical alignment with the sides of the vessel. The condenser 4 has plates opposing each other at an angle of 180° or, in other words, they are approximately parallel to each other. The condenser 4 could be replaced, for example by two toroidal coils (not shown) for making inductive level measurements. Such coils would be arranged outside of the intermediate vessel at the upper and lower melt levels. At the bottom of the intermediate vessel 3, a delivery pipe 5 emerges and terminates slightly above the maximum filling level of the intermediate vessel.

The storage vessel 1 can be hermetically sealed with a cover 6. A pressure gas control line 7 is applied into the cover 6. The cover 6 includes a fill hole 8 which can be sealed hermetically with a lid 9. It is preferred that the storage vessel 1 be heated and, for this purpose, a number of electrical heating rods 10 are arranged in preferably vertical bores from the vessel wall and uniformly surround the contents of the vessel. The melt level within storage vessel 1 can be measured by various measuring devices, however, a method using radioactive radiation sources and corresponding receivers have been found particularly satisfactory.

The intermediate vessel 3 can be hermetically sealed with a removable cover 13. In addition to the overflow pipe 2 a pressure gas control line 14 and a feed pipe 15 for a seeding agent or inoculant opens into the interior of vessel 3. A device for distributing the inoculant consists of a storage vessel 16 from which an inoculant, for example, ferrous silicon, is brought into pipe 15 by way of a dosing trough 17 with a vibration drive. Pipe 15 includes a valve 18 so that the intermediate vessel 3 can be sealed gas tight after the addition of the inoculant. The amount of inoculant receiving agent supplied is proportional to the respective time during which the dosing trough 17 is connected. The intermediate vessels 3 can be heated by a number of heating rods 19 which are preferably arranged in bores extending perpendicular to the represented sectional area, both below the intermediate vessels 3 and on the side opposite the outlet opening. The delivery pipe can similarly be heated by heating rods 20, which are arranged preferably in bores extending parallel to the axis and distributed over the circumference of the delivery pipe. In the pressurized gas control line 14, a throttle 21 and a storage 22 are preferably arranged. The throttle and storage function to control the amount of metal to be cast within a certain time. The storage vessel 1 with its overflow pipe 2, as well as the intermediate vessel 3, with its associated delivery pipe 5, are preferably lined with refractory material.

The operation of the described arrangement for the measured delivery of molten metal in doses may be described as follows. Initially a large amount of metal to be cast or otherwise utilized can be poured through the fill hole 8 into the storage vessel 1. It is understood that the amount poured into the storage vessel is much larger than that to be supplied to a mold at any given time. When the desired filling height has been reached, the storage vessel is sealed airtight with the lid 9. Pressurized gas is then supplied to the storage vessel by opening valve 24 and closing the pressure release valve 12 in control line 7. In this manner, the melt is sent into the smaller intermediate vessel 3 through pipe 2. The gas pressure within intermediate vessel 3 remains reduced because pressure release valve 26 is open to atmospheric pressure. When the desired level corresponding to the predetermined casting weight for a casting mold 25 has been reached in the intermediate vessel 3, a device controlled by condenser 4 stops the pressure gas supply to the storage vessel by closing valve 24 so that the melt feed into the intermediate vessel is stopped. After the closing of valve 24, the generated pressure is maintained within the storage vessel 1.

It is preferred to add the inoculant or seeding agent into the intermediate vessel 3 through line 15 prior to the above-mentioned transfer of molten metal from the storage vessel 1 in order to achieve a thorough mixing of the melt and inoculant by the filling process.

In order to deliver the melt in the intermediate vessel 3 to mold 25, valves 18 and 26 are closed and valve 23 opened. At this time, pressurized gas is introduced through line 14 into the intermediate vessel 3 and the melt is forced out through pipe 5. The melt is only slightly pushed back into the overflow pipe 2 because the pressure is maintained in storage vessel 1. If the intermediate vessel 3 is emptied down to a predetermined level 11', this is measured and sensed by the condenser 4 which operates to close valve 23. The dosing process is thus completed and the pressurized gas within the intermediate vessel can flow into the atmosphere by opening valve 26 or it can return to a main storage (not shown).

When the atmospheric pressure is restored in the intermediate vessel 3, a new cycle can commence by again introducing a predetermined amount from the storage vessel 1 into the intermediate vessel 3 for dosed delivery by again increasing the gas pressure supplied by line 7 to the storage vessel.

FIG. 2 illustrates the slope versus time of the amount of iron cast, as preferred for casting mold 25. The abscissa x represents time and the ordinate y represents the quantity of flow of metal. The hatched area corresponds to the total amount cast per cycle which is available in doses in the intermediate vessel 3. The represented graph of the quantity of flow is achieved by corresponding control of the pressurized gas in line 14. After opening control valve 23, the pressure in the intermediate vessel 3 is suddenly increased by delivering the pressurized gas stored in a storage chamber 22 and simultaneously adding an amount of gas which is additionally controlled by a throttle 21. As can be seen from the diagram of FIG. 2, a greater amount is initially case for rapid filling of the gate system of the mold 25, while subsequently, only the pouring gate of the mold is to be kept full until the cavity of the mold is filled. Either compressed air or inert gas may be used satisfactorily as the pressurized gas of the present invention. For example, nitrogen or argon may be used in order to avoid oxidation on the surface of the melt.

Accordingly, the disclosed arrangement achieves a number of advantages. First, by delivering molten metal from a smaller intermediate vessel, the accuracy of dosing and the delivery rate or the succession of cycles can be greatly increased and the dynamics of the casting process substantially improved since only small amounts need be accelerated. Second, since the arrangement is designed as a closed unit with optimum heating possibilities, it is possible, for example, to hold magnesium-treated cast iron for the delivery of spherical graphite for a long time with a minimum of magnesium loss or temperature loss. Finally, with the possibility of adding seeding agents or inoculants shortly before casting, the so-called inoculation decay effect can be kept low and a good and uniform inoculation effect can be achieved.

While the foregoing specification and accompanying drawings represent the preferred embodiments of the present invention, it will be obvious to those skilled in the art that various changes and modifications may be made therein without departing from the true spirit and scope of the present invention.

What is claimed is:

1. An arrangement for the delivery of predetermined amounts of the molten contents of a sealed and heated storage vessel having an overflow pipe wherein delivery is controlled by pressurized gas, said arrangement comprising:

a storage vessel having an overflow pipe and a closeable opening to insert a molten charge;

an intermediate vessel, said vessel being sealed and into which said overflow pipe opens, said intermediate vessel being provided with a rising delivery pipe;

means included in said intermediate vessel for measuring the molten charge contained in the intermediate vessel;

first gas pressure lines, said lines having pressure release means, for providing pressurized gas to said storage vessel, said first gas pressure line being individually controllable; and second gas pressure lines, said second gas pressure lines having pressure release means, for providing pressurized gas to said intermediate vessel, said second lines being individually controllable, said second gas pressure lines having preset control means for providing a high initial gas pressure followed by a lower gas pressure so that said second lines, when opened, cause a high initial flow of metal from said intermediate vessel followed by a smaller, substantially constant flow thereafter.

2. The arrangement of claim 1 wherein said preset control means includes a constant-pressure gas source, a closed, pressurized gas storage chamber, a throttle connected between said source and said chamber, the throttle output and output of said storage chamber being combined and coupled by the gas-pressure line and a valve to the intermediate vessel.

3. An arrangement for the delivery of predetermined amounts of the molten contents of a storage vessel, said arrangement comprising:

a storage vessel having an overflow pipe and a closeable opening to insert a molten charge, said vessel being sealed when said opening is closed;

an intermediate vessel, said vessel being sealed and into which said overflow pipes opens, the end of said overflow pipe within said intermediate vessel being at a higher level than the end within the storage vessel, said intermediate vessel being provided with a rising delivery pipe;

measuring means, provided in said intermediate vessel, for providing an electrical parameter which corresponds to the molten charge within said intermediate vessel;

first gas-pressure lines, said lines having pressure release means, for providing pressurized gas to said storage vessel, said pressurized gas for forcing molten metal from said storage vessel through said overflow pipe into said intermediate vessel, said first gas-pressure lines being individually controllable; and second gas-pressure lines, said second lines having pressure release means, said pessurized gas for forcing molten metal from said intermediate vessel through said delivery pipe, said second gas lines being individually controllable, said second gas-pressure lines including means for controlling the slope of the amount of metal delivered by said delivery pipe versus time, said means including a closed, pressurized gas storage chamber and a constant-pressure adjustable gas source, said storage chamber and adjustable gas source being combined in a single gas line to provide a high initial gas pressure followed by a lower gas pressure when said single gas line is opened.

* * * * *